United States Patent [19]

Foss et al.

[11] 4,449,456

[45] May 22, 1984

[54] SAFETY DEVICE FOR A PROJECTILE

[75] Inventors: Morten Foss, Tollerudbakken; Kaare R. Strandli, Lyngveien, both of Norway

[73] Assignee: A/S Raufoss Ammunisjonsfabrikker, Raufoss, Norway

[21] Appl. No.: 342,811

[22] Filed: Jan. 26, 1982

[30] Foreign Application Priority Data

Sep. 21, 1981 [NO] Norway ..... 813195

[51] Int. Cl.[3] ..... F42C 15/22; F42C 15/34

[52] U.S. Cl. ..... 102/240; 102/229; 102/245

[58] Field of Search ..... 102/237, 239, 240, 244, 102/245, 254, 223, 229

[56] References Cited

U.S. PATENT DOCUMENTS

| | | | |
|---|---|---|---|
| 2,164,797 | 7/1939 | Birkigt | 102/237 X |
| 2,362,987 | 11/1944 | Church et al. | 102/240 X |
| 3,076,410 | 2/1963 | Guerne | 102/240 |
| 3,450,048 | 6/1969 | Guerne | 102/240 |
| 3,750,589 | 8/1973 | Egli et al. | 102/237 |
| 4,223,608 | 9/1980 | Backstein et al. | 102/237 X |
| 4,242,963 | 1/1981 | Ziemba | 102/240 X |

*Primary Examiner*—David H. Brown

*Attorney, Agent, or Firm*—Watson, Cole, Grindle & Watson

[57] ABSTRACT

A safety device for a projectile, adapted to make a barrier between an ignition charge in the forward end of the projectile and one or more incendiary and/or explosive charges situated behind the ignition charge. The device comprises two discs having concentric apertures therethrough, situated behind the ignition charge. A plug constituting the barrier is situated in the aperture in the foremost disc, and a split ring which is held together by a spring supports the plug, the split ring being supported by the rearmost disc. The plug comprises at least one portion adapted to seal the aperture in the foremost disc when being exposed to pressure developed by firing of the ignition charge prior to arming of the projectile. Arming takes place only when the projectile reaches a rotational velocity sufficient to open the split ring because of the centrifugal forces, whereby these forces exceed the resistance of the spring. In this condition the plug is allowed to pass rearwardly and to impact against the incendiary and/or explosive charge or charges, and the combustion gases from the ignition charge are also allowed to move together with the plug, whereby ignition of the other charge or charges takes place.

9 Claims, 5 Drawing Figures

SAFETY DEVICE FOR A PROJECTILE

BACKGROUND OF THE INVENTION

1. Field of the Invention

The present invention relates to a safety device for a projectile, the device providing a barrier within the connection between an ignition charge in the forward end of the projectile and one or more incendiary charges and/or explosive charges located behind the ignition charge, the projectile including two discs having concentric apertures which are situated behind the ignition charge and means adapted to make a barrier for preventing shock waves and/or flames under high pressure, caused by combustion of the ignition charge, to pass through the apertures until the projectile has been given a rotational velocity which is sufficient to cause arming.

2. The Prior Art

A projectile of the above kind is in principle known from Norwegian Acceptance Print No. 137.735, which describes the use of a non-combustible, particulate material as a flame barrier between the discs. Due to rotation of the projectile after firing from a gun and as a result of the generated inertia forces, a channel is formed in the particulate material through which the flames from the ignition charge can pass.

The object of the present invention is to achieve a safety device which, in addition to assuring a high degree of safety, also contributes to improving the igniting of the charge or charges behind the ignition charge.

SUMMARY OF THE INVENTION

According to the present invention, the means adapted to make the barrier comprises a plug situated in the aperture through the foremost disc, and a split ring which is held together by a spring and supports the plug, the ring being supported by the rearmost disc, and at least one portion of the plug is adapted to seal the aperture upon being exposed to pressure developed by firing of the ignition charge prior to arming.

According to the invention, the ignition charge may be a charge which ignites merely by impact, i.e., without the aid of an ignition mechanism, or a charge which is ignited by use of mechanical means, as for instance a firing pin.

During a normal firing of a projectile equipped with a safety device according to the invention, the rotation of the projectile will force the parts of the ring radially outwardly, because the inertia forces will exceed the resistance from the spring even at a rotational velocity which is smaller than the maximum rotational velocity of the projectile during the flight. The ignition charge will be ignited when the projectile impacts a target, and the combustion gases will force the plug rearwardly through the apertures in the discs and into the nearest charge behind the discs, whereupon this charge, and possible charges behind it, will be effectively ignited because of the impact of the plug combined with the shock wave and/or hot gases from the ignition charge.

If, however, the ignition charge is ignited before the projectile has reached the necessary rotational velocity to causing arming, as for instance by an unintended ignition during handling, the safety device ring will not be opened, but will prevent the plug from moving towards the rearward charge or charges.

In such a case the plug will make a seal in the apertures through the forward disc. This may be achieved by means of sealing rings, or by expansion of the plug or a portion thereof, caused by the axial force acting on the plug as a result of the pressure. Expansion of the plug can be achieved also if the plug is massive, but the plug may be partly hollow.

The invention will hereinafter be explained more in detail, with reference to the accompanying drawings, which show embodiments of the invention.

DESCRIPTION OF THE DRAWINGS

In the drawings all parts which are equal or functionally equivalent have been given the same or similar reference numerals.

DETAILED DESCRIPTION OF THE PREFERRED EMBODIMENTS

In this specification the expressions "forward", "rearward" and related expressions apply to directions relative to the launching direction of the projectile.

Figure 1:
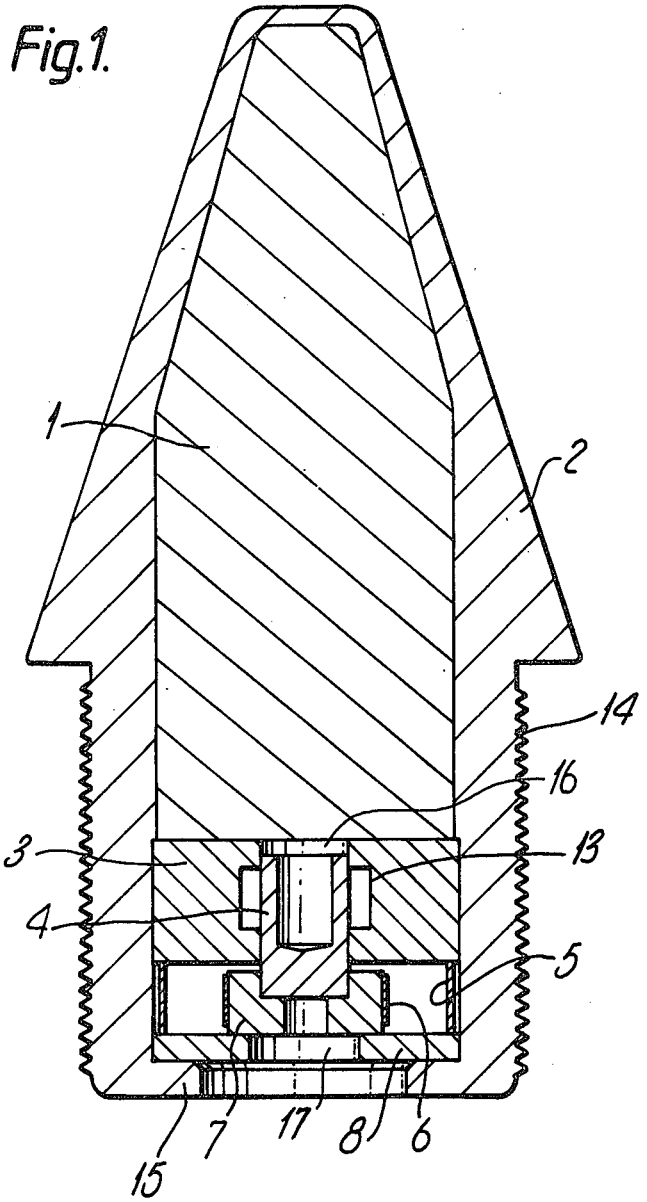
FIG. 1 shows a device in accordance with the invention, placed in a nose portion of a projectile.

FIG. 1 shows a nose portion 2 of a projectile. Inside the nose portion 2 is shown an ignition charge 1 which is adapted to ignite when the projectile impacts against a target. Within the scope of the invention the nose portion may also comprise an ignition device in addition to an ignition charge, as for instance a detonator. The ignition device may for instance comprise a firing pin.

Behind the ignition charge 1 is a foremost disc 3 and a rearmost disc 8, each having a respective 16, 17 aperture. In the aperture 16 of the foremost disc 3 is a plug 4 which is supported by a split ring 7. The ring is kept assembled by means of a spring 6, and is situated in the space between the two discs 3 and 8. The length of this space is defined by the length of a spacer ring 5. The above-mentioned parts are assembled by being introduced in the nose portion from the rear end thereof, and the rearmost disc 8 is secured by deforming a collar on the nose portion 2 radially inwardly, thereby forming a locking flange 15. The foremost disc 3 may be screwed into threads inside the nose portion 2. The nose portion 2 is of course adapted to be mounted as the front portion on a projectile body (not shown), and for the that purpose the embodiment shown has a threaded portion 14.

The plug is hollow in its forward end, and the aperture 16 in which the plug is located has a ring shaped, widened area 13 around the hollow portion of the plug.

During a normal firing from a gun the ring 7 will be opened because the centrifugal forces caused by the high rotational velocity of the projectile will exceed the resistance of the spring 6. Thus, the plug 4 will be free to move rearwardly, but it will remain in its forward position until the projectile hits a target, because the projectile will be slowing down after leaving the gun.

When the projectile hits a target the ignition charge will ignite, and the plug 4 will be propelled rarwardly and will impact against the charge or charges in the projectile body. Simultaneously flames and combustion gases from the ignition charge will follow the plug, and the charge or charges in the projectile body will be ignited. The plug 4 contributes to this ignition because of the impact against the charge or charges.

If, however, the ignition charge 1 is ignited before the projectile has been armed, i.e., before the projectile has reached a rotational velocity sufficient to cause opening of the ring 7, the pressure of the combustion gases will act against the plug, which is locked against moving rearwardly because it cannot pass through the narrow aperture defined by the closed ring 7. The thin walls in the hollow portion of the plug will be deformed outwardly, and will be pressed into the widened area 13. This deformation of the plug 4 will cause an effective sealing between the plug 4 and the disc 3. The plug 4 and the disc 3 will be "welded" together, and the combustion gases from the ignition charge will be prevented from igniting the rearward charge or charges. Thus, the projectile will be effectively protected against inadvertent ignition of the charge or charges in the projectile body. In projectiles of relatively small calibers, as for instance 40 mm, an ignition charge may be used which is significantly less dangerous than the main charge or charges in the projectile body, and the damage caused by the ignition charge alone will be very small compared with the damage caused if the main charge or charges is or are also ignited.

Thus, arming of the projectile can only take place by giving the projectile a rotational velocity which exceeds a certain limit.

Figure 2:
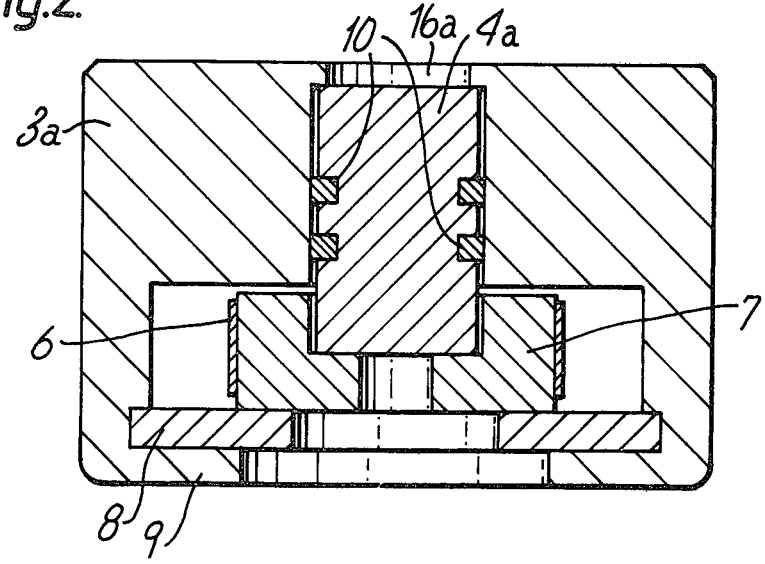
FIG. 2 shows an embodiment of the inventive device in which the plug is a massive cylinder having sealing rings.

FIG. 2 shows an embodiment in which the plug **4*a* has sealing rings 10. Thus, sealing is established when the plug is placed in the aperture 16*a* of the disc 3*a*. During a normal firing and impact against a target, the plug 4*a* will be propelled through the disc 3*a* in a manner similar to the movement of a piston in a combustion engine. In this embodiment the disc 3*a* is integral with the flange 9, and a spacer ring between the two discs 3*a* and 8** is not provided.

Figure 3:
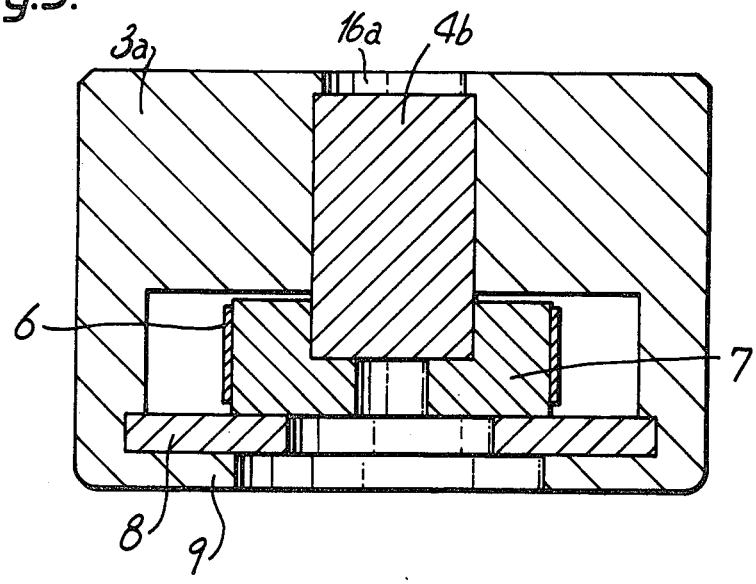
FIG. 3 shows an embodiment in which the plug is a massive cylinder, adapted to expand radially in order to seal the aperture.

FIG. 3 shows an embodiment in which the plug **4*b* is a massive cylinder. During a normal firing and impact against a target, the projectile will be armed, and the plug will be propelled rearwardly when the ignition charge is ignited, but if the ignition charge is ignited when the projectile is not armed, the ring 7 will prevent movement of the plug 4*b*, whereby the plug will be compressed axially and will expand radially, thereby establishing a seal against the disc 3*a*. The plug material must be properly chosen with respect to deformation properties and specific mass in order to prevent the plug from being stuck in the aperture 16*a* after a normal firing and in order to assure that an effective seal is achieved by ignition of the ignition charge prior to arming of the projectile. Except for the plug 4*b*, the parts shown in FIG. 3 are similar to those shown in FIG. 2**.

Figure 4:
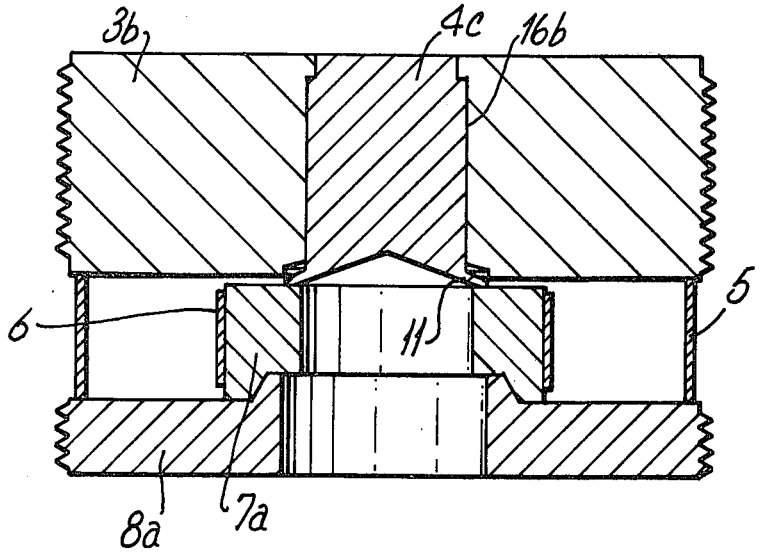
FIG. 4 shows an embodiment in which the plug comprises a rearwardly facing conical portion.

FIG. 4 shows an embodiment in which the plug **4*c* has a rearwardly facing conical portion 11. The conical portion 11 rests against the split ring 7*a*, and is situated in a widened portion of the aperture 16*b* in the disc 3*b*. If the ignition charge is ignited when the projectile is not armed, the plug 4*c*, being locked by the ring 7*a* against rearward movement, will move somewhat during a simultaneous deformation of the conical portion 11, and the portion 11 will move further into the widened portion of the aperture in the disc 3*b*. This will cause sealing against penetration of the combustion gases from the ignition charge. FIG. 4, moreover, shows two separate discs 3*b* and 8*a* and a spacer ring 5**, both of these discs being threaded in order to be screwed into the nose portion of the projectile.

Figure 5:
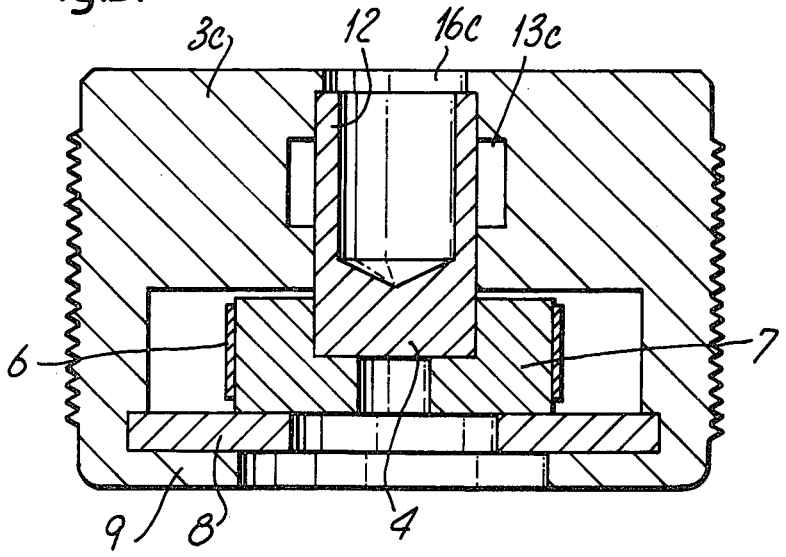
FIG. 5 shows mainly the same embodiment as shown in FIG. 1, in which the plug has a hollow thin walled portion in the forward end.

FIG. 5 shows an embodiment in which the plug 4 has the same shape as shown in FIG. 1, while the foremost disc **3*c* and the flange 9 that supports the rearmost disc 8 is constructed in the same manner as shown in FIGS. 2 and 3, with the exception that the aperture in the disc 3*c* has a widened portion 13*c*. The embodiment shown in FIG. 5** is adapted to be screwed into the nose portion of the projectile.

In FIGS. 2, 3, 4 and 5 the apertures **16*a*, 16*b*, 16*c* in the discs 3*a*, 3*b*, 3*c* are shown having a narrow portion defined by a flange, the inner diameter of which is smaller than the diameter of the main part of the plug 4, 4*a*, 4*b*, 4*c***. This feature prevents the plug from falling out of the aperture prior to being inserted in the nose portion of the projectile, and in addition the narrow portion assures that the plug will not be able to move forwardly and impact against the ignition charge, which might cause inadvertent ignition, for instance when the projectile slows down during its flight.

In the embodiment shown in FIGS. 1, 2, 3 and 5 the ring 7 is centered because the plug 4, **4*a*, 4*b*, 4*c* is placed in a widened portion of the ring. In the embodiment shown in FIG. 4 the ring 7*a* is centered because the rearmost disc 8*a* has a collar that extends into a complementary shaped recess in the ring 7*a***.

In the embodiments where it is presupposed that deformation of the plug is to take place in order to achieve sealing against passage of the combustion gases, it is preferred to make the plug of light metal, as for instance aluminium. In the embodiment shown in FIG. 2 the plug, however, may be made of a material which is not easy to deform, as for instance steel.

The foremost disc 3, **3*a*, 3*b* or 3*c* may be made of light metal (or a light metal alloy). Also the rearward disc 8** may be made of such a material. The above-mentioned materials, however, do not make any limitation with respect to the scope of the invention, and the materials used may be chosen on basis of the necessary strength, deformation capabilities and other properties.

We claim:

1. A safety device for a projectile, adapted to make a barrier between an ignition charge in the forward end of the projectile and one or more incendiary and/or explosive charges behind the ignition charge, said device comprising two discs having concentric apertures and being situated behind the ignition charge, the disc nearer the ignition charge being called the foremost disc and the disc further from the ignition charge being called the rearmost disc, each of said foremost and rearmost discs having an aperture extending therethrough, wherein means adapted to make the barrier comprise a plug situated in the aperture through the foremost disc, and a split ring which is held together by a spring supports said plug, said split ring being supported by the rearmost disc, and at least one portion of said plug is adapted to seal the aperture in the foremost disc when being exposed to pressure developed by the ignition charge prior to arming of the projectile.

2. A safety device as claimed in claim 1, wherein the rear end of the plug has a rearwardly facing conical collar situated in a recess in the foremost disc and rests against the split ring.

3. A safety device as claimed in claim 1, wherein the rear end of the plug extends into a recess in the split ring.

4. A safety device as claimed in claim 1, wherein the forward end of the aperture in the foremost disc has a narrow portion of a diameter less than that of the plug.

5. A safety device as claimed in claim 1, wherein the plug is made of a light metal or a light metal alloy.

6. A safety device as claimed in claim 1, wherein the plug is cylindrical.

7. A safety device as claimed in claim 1 or 2, wherein at least one sealing ring is provided between the plug and the wall in the aperture extending through the rearmost disc.

8. A safety device as claimed in claim 1 or 6, wherein the plug comprises a hollow portion defined by relatively thin walls facing towards said forward end of the projectile, and wherein the aperture extending through the foremost disc has a ring shaped widened portion, at least along a part of the hollow portion of the plug located therein.

9. A safety device as claimed in claim 8, wherein at least one end of the widened portion of the aperture extending through the foremost disc has a sharp edge in the transition to the rest of the aperture.

* * * * *